US008947310B2

(12) United States Patent
Cheng et al.

(10) Patent No.: US 8,947,310 B2
(45) Date of Patent: Feb. 3, 2015

(54) DUAL-BAND ANTENNA

(71) Applicant: Wistron NeWeb Corporation, Hsinchu (TW)

(72) Inventors: Kai-Yang Cheng, Hsinchu (TW); Ming-Feng Chang, Hsinchu (TW); Chih-Ming Wang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 166 days.

(21) Appl. No.: 13/745,857

(22) Filed: Jan. 20, 2013

(65) Prior Publication Data

US 2014/0071009 A1 Mar. 13, 2014

(30) Foreign Application Priority Data

Sep. 7, 2012 (TW) ..... 101132787 A

(51) Int. Cl.
*H01Q 13/10* (2006.01)
*H01Q 5/00* (2006.01)
*H01Q 13/16* (2006.01)

(52) U.S. Cl.
CPC ..... *H01Q 13/10* (2013.01); *H01Q 5/0058* (2013.01); *H01Q 5/0062* (2013.01); *H01Q 13/16* (2013.01)
USPC ..... 343/770

(58) Field of Classification Search
USPC ..... 343/702, 767, 770
See application file for complete search history.

(56) References Cited

U.S. PATENT DOCUMENTS

| | | | | |
|---|---|---|---|---|
| 6,677,909 | B2 * | 1/2004 | Sun et al. | 343/767 |
| 8,441,404 | B2 * | 5/2013 | Chiang et al. | 343/770 |
| 8,508,418 | B2 * | 8/2013 | Kough et al. | 343/702 |
| 2010/0053011 | A1 * | 3/2010 | Kurashima et al. | 343/767 |
| 2010/0321255 | A1 | 12/2010 | Kough | |
| 2011/0241948 | A1 * | 10/2011 | Bevelacqua et al. | 343/702 |
| 2012/0026048 | A1 | 2/2012 | Vazquez | |
| 2013/0009833 | A1 * | 1/2013 | Kough et al. | 343/770 |
| 2013/0342408 | A1 * | 12/2013 | Chang et al. | 343/720 |
| 2014/0078009 | A1 * | 3/2014 | Wong et al. | 343/728 |

* cited by examiner

*Primary Examiner* — Tan Ho
(74) *Attorney, Agent, or Firm* — Winston Hsu; Scott Margo

(57) ABSTRACT

A dual-band antenna utilized in a wireless communication device for receiving or transmitting wireless signals of a first frequency band and a second frequency band includes a rectangular metal plane formed with a slot structure substantially extending from a first side to a second side of the rectangular metal plane, a feeding terminal formed on the rectangular metal plane, and a grounding element, disposed on a third side or a fourth side of the rectangular metal plane, for electrically connecting the rectangular metal plane and a system ground of the wireless communication device, wherein the first side is substantially parallel to the second side, the third side is substantially parallel to the fourth side, and the first side is substantially perpendicular to the third side or the fourth side.

11 Claims, 15 Drawing Sheets

DUAL-BAND ANTENNA

BACKGROUND OF THE INVENTION

1. Field of the Invention

The present invention relates to a dual-band antenna, and more particularly, to a dual-band antenna capable of achieving dual-band operation and reducing occupied area.

2. Description of the Prior Art

An electronic product with wireless communication function, such as a notebook, tablet computer, personal digital assistant and any other portable electronic device, receives or emits radio waves through an antenna to deliver or exchange radio signals, so as to access wireless network. As consumers' requirements for appearance and functions of the portable electronic device continuously increase, an available space for each component in the portable electronic device becomes much smaller, which limits the available space for an antenna.

As well known by those skilled in the art, a basic concept of antenna design is that a frequency band of wireless signals received or transmitted by an antenna is related to a current path provided by the antenna, which restricts a basic dimension of the antenna. In addition, if wireless signals to be received or transmitted cover multiple frequency bands, the antenna design becomes more complicated, and the objective of multi-band operation may not be achieved in a restricted environment.

Therefore, how to reduce the required space of an antenna and also maintain the antenna in normal operation becomes one of the industry goals.

SUMMARY OF THE INVENTION

It is therefore an objective of the claimed invention to provide a dual-band antenna capable of achieving dual-band operation and reducing occupied area.

The present invention discloses a dual-band antenna for receiving or transmitting wireless signals of a first frequency band and a second frequency band in a wireless communication device. The dual-band antenna comprising a rectangular metal plane, formed with a slot structure substantially extending from a first side to a second side of the rectangular metal plane; a feeding terminal, formed on the rectangular metal plane; and a grounding element, disposed on a third side or a fourth side of the rectangular metal plane, for electrically connecting the rectangular metal plane and a system ground of the wireless communication device; wherein the first side is substantially parallel to the second side, the third side is substantially parallel to the fourth side, and the first side is substantially perpendicular to the third side or the fourth side.

These and other objectives of the present invention will no doubt become obvious to those of ordinary skill in the art after reading the following detailed description of the preferred embodiment that is are in the various figures and drawings.

DETAILED DESCRIPTION

Figure 1:
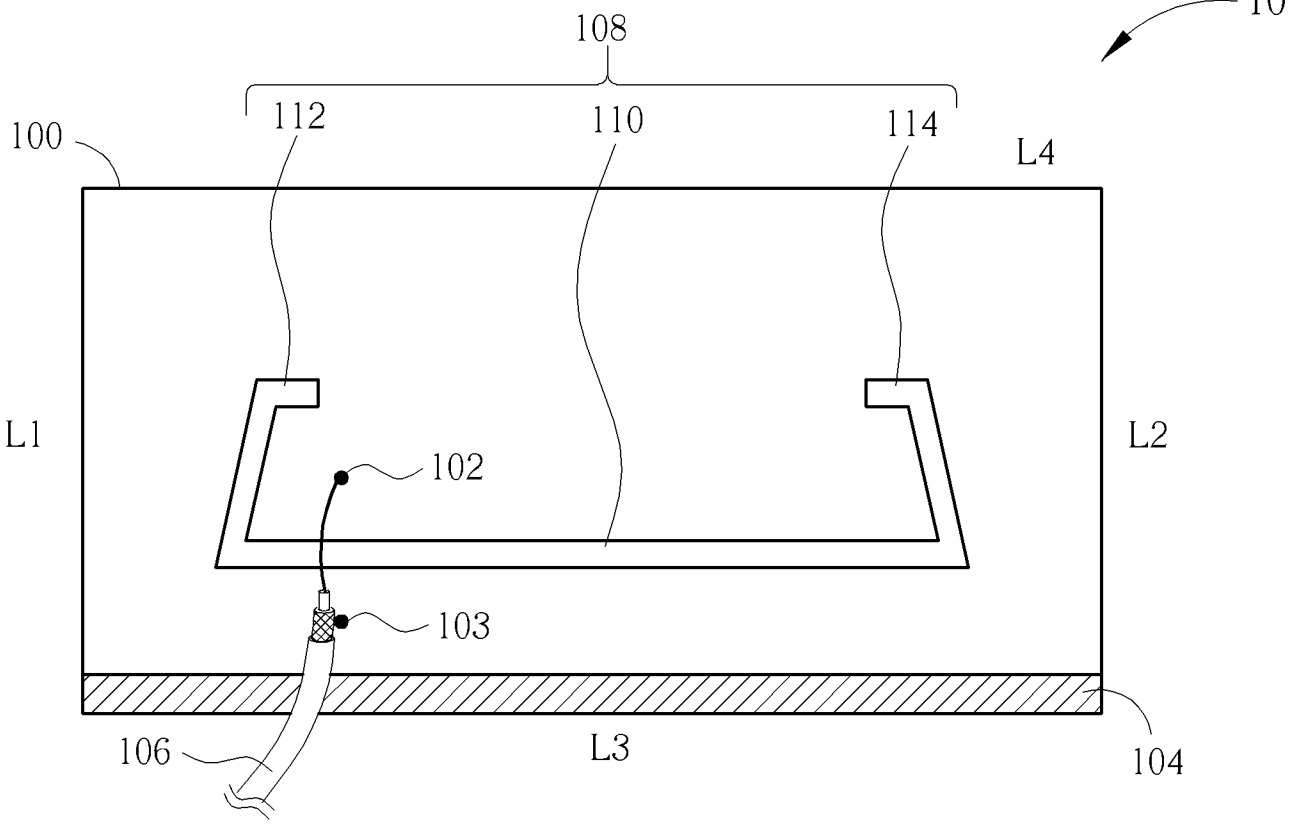
FIG. 1 is a schematic diagram of a dual-band antenna according to an embodiment of present invention.

Please refer to FIG. 1. FIG. 1 is a schematic diagram of a dual-band antenna 10 according to an embodiment of the present invention. The dual-band antenna 10 is a slot antenna in a wireless communication device such as a notebook computer system. For example, the dual-band antenna 10 may be formed on a barrel area or near a monitor of the notebook computer system, for receiving and transmitting wireless signals of two different frequency bands, such as 2.4 GHz and 5 GHz. The dual-band antenna 10 comprises a rectangular metal plane 100, a feeding terminal 102 and a ground element 104. A slot structure 108 is formed on the rectangular metal plane 100 by means of etching or punching. As can be seen from FIG. 1, the slot structure 108 substantially extends from a first side L1 to a second side L2 of the rectangular metal plane 100. The grounding element 104 is disposed on a third side L3 of the rectangular metal plane 100 for electrically connecting the rectangular metal plane 100 and a system ground of the wireless communication device. Accordingly, a low-frequency characteristic can be enhanced and a dimension of rectangular metal plane 100 can be reduced. In addition, the dual-band antenna 10 transmits signals through a signal transmission line 106 composed of a metal wire, an isolation layer, a metal weave and a protection layer from inside to outside. The metal wire electrically connects to the feeding terminal 102 by means of welding for transmitting signals. The isolation layer covers the metal wire. The metal weave covers the isolation layer and electrically connects to a welding point 103 of the rectangular metal plane 100 by the means of welding for connecting the signal ground. And, the protection layer covers the metal weave.

In the dual-band antenna 10, the slot structure 108 is a main portion constructing the slot antenna, and comprises a first rectangular slot 110, a first L-shape slot 112 and a second L-shape slot 114. The first rectangular slot 110 horizontally extends along the rectangular metal plane 100, e.g. extending from the first side L1 to the second side L2 of the rectangular metal plane 100. The first L-shape slot 112 and the second L-shape slot 114 are substantially formed in a shape of "L" as their names imply and connect with the first rectangular 110 to form a shape of ox horn. Taking the first L-shape slot 112 as an example, the first L-shape slot 112 comprises a perpendicular segment and a horizontal segment. Although the perpendicular segment is not absolutely perpendicular to the first rectangular slot 110, it can still be seen by referring to the FIG. 1 that the perpendicular segment substantially extends from the third side L3 to the fourth side L4 of the rectangular metal plane 100. Moreover, the horizontal segment is substantially parallel to the first rectangular slot 110 and extends from the first side L1 to the second side L2 of the rectangular metal plane 100. The structures of the second L-shape slot 114 and the first L-shape 112 are similar and substantially symmetrical. In addition, a length of the first rectangular slot 110 is corresponding to a half of a wavelength of a signal corresponding to the lower frequency band of the two operation frequency bands (such as 2.4 GHz in 2.4 GHz and 5 GHz)

and can receive and transmit signals of the higher frequency band by frequency multiplication. The first L-shape slot 112 and the second L-shape 114 are used to adjust a matching status. For example, lengths of or angles between the perpendicular segment and the horizontal segment of each of the first L-shape slot 112 and the second L-shape 114 can be appropriately adjusted to obtain the required matching effect.

Figure 2:
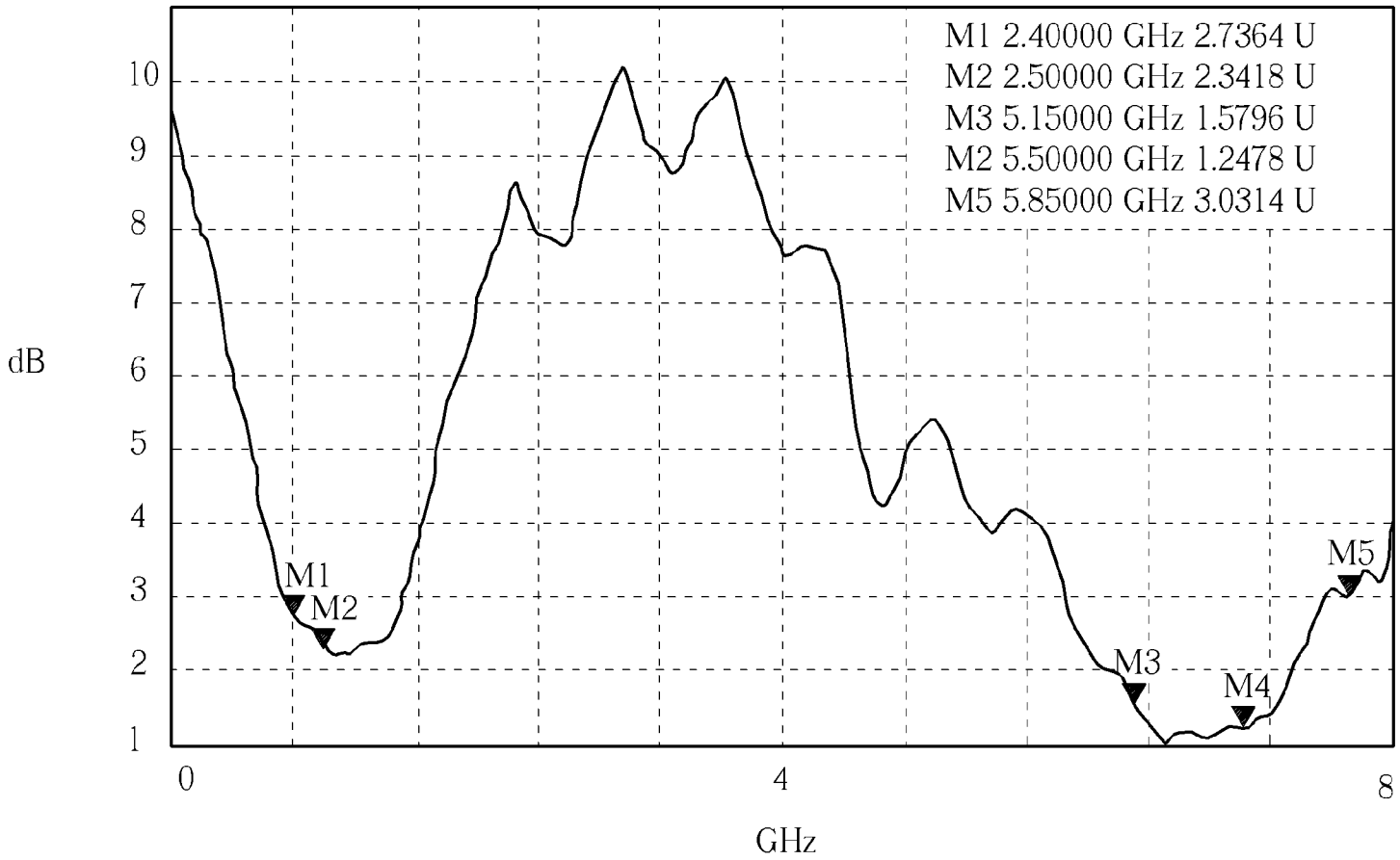
FIG. 2 is a schematic diagram of a voltage to standing wave ratio of the dual-band antenna according to FIG. 1.

As mentioned in the above, the grounding element 104 is electrically connected to the rectangular metal plane 100 and the system ground, such that the low-frequency characteristic can be enhanced and the dimension of the rectangular metal plane 100 can be reduced. Taking the operation frequency band 2.4 GHz and 5 GHz as an example, the minimum distance between the slot structure 108 and the first side L1 or the second side L2 (i.e., the distance between the first L-shape slot 112 and the first side L1 or the distance of the second L-shape slot 114 and the second side L2) is substantially smaller than 3 millimeters and between 2 to 3 millimeters. Comparing to a conventional slot antenna, such a minimum distance can reduce the required space effectively. For example, please refer to FIG. 2, which is a schematic diagram of voltage standing wave ratio (VSWR) of the dual-band antenna 10. As can be seen from FIG. 2, the dual-band antenna 10 actually transmits and receives signals in the frequency band 2.4 GHz and 5 GHz. Therefore, the dual-band operation is achieved.

Figure 3A:
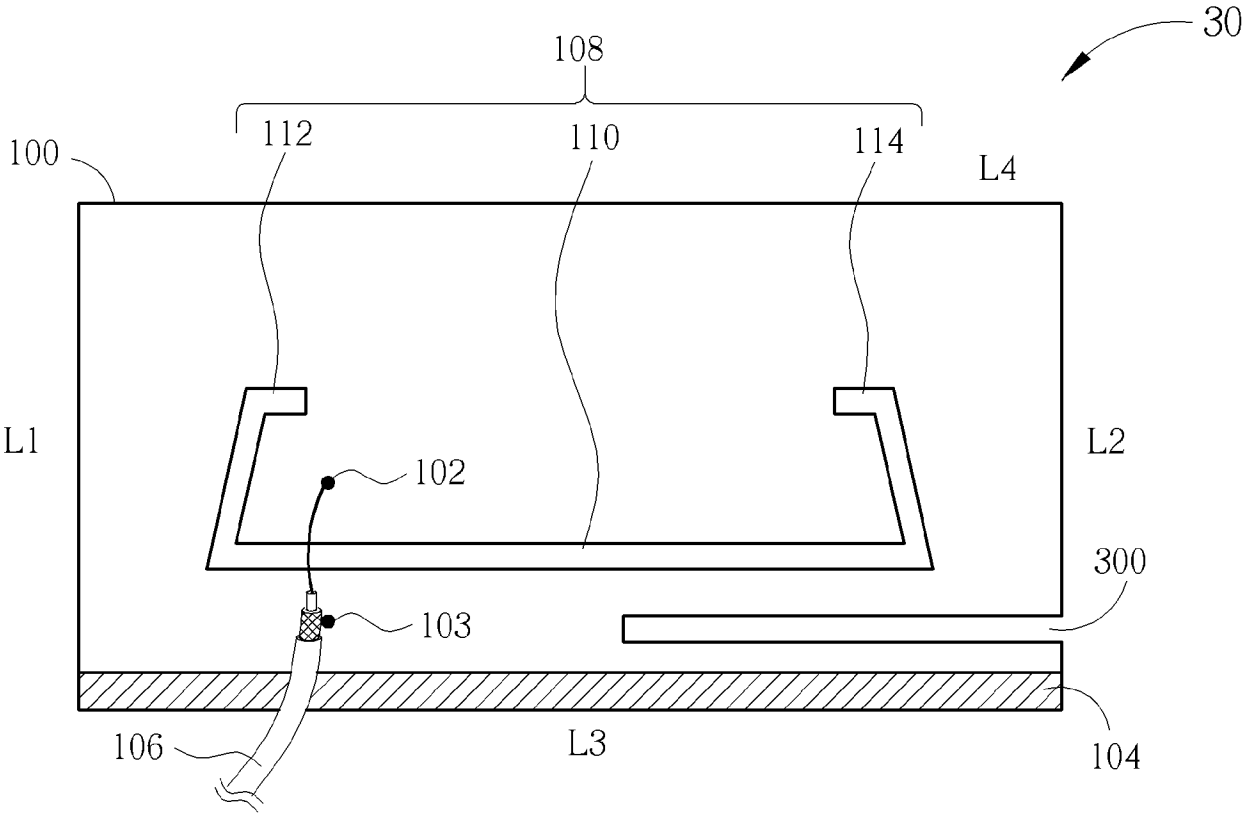
FIG. 3A and FIG. 3B are schematic diagrams of adding a second rectangular slot and an extending slot respectively to the dual-band antenna in FIG. 1.
Figure 3B:
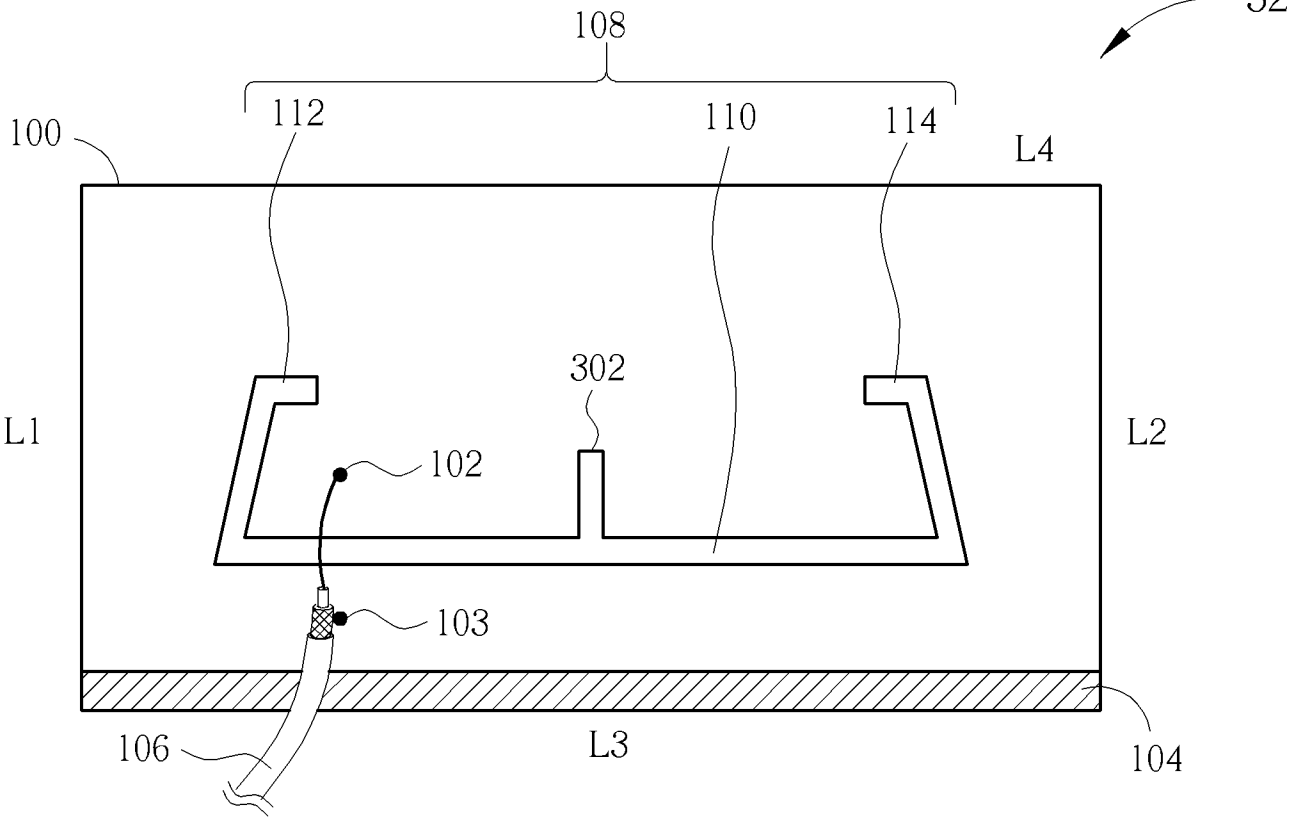

Please note that the dual-band antenna 10 shown in FIG. 1 is an embodiment of the present invention, and those skilled in the art can make modification and alterations accordingly. For example, in FIG. 1, the grounding element 104 is disposed on the third side L3 of the rectangular metal plane 100, but is not limited thereto. The grounding element 104 can also be disposed on the fourth side L4 of a rectangular metal plane 100. In addition, please refer to the FIG. 3A and FIG. 3B. FIG. 3A and FIG. 3B are schematic diagrams of dual-band antennas 30 and 32 according to embodiments of the present invention. The dual-band antenna 30 and 32 are derived from the dual-band antenna 10 shown in FIG. 1 by adding a second rectangular slot 300 and an extending slot 302 respectively. As shown in FIG. 3A, the second rectangular slot 300 is parallel to the first rectangular slot 110 and extends from the first side L1 to the second side L2 of the rectangular metal plane 100, but the second rectangular slot 300 has an opening formed on the second side L2 for enhancing the efficiency of transmitting and receiving wireless signals. Furthermore, as shown in FIG. 3B, the extending slot 302 extends from the first rectangular slot 110 to the fourth side L4 of the rectangular metal plane 100 to increase the path of the first rectangular slot 110 for enhancing the efficiency of transmitting and receiving wireless signals. Please note that FIG. 3A and FIG. 3B are examples for enhancing the efficient of transmitting and receiving wireless signals and can be configured individually or simultaneously according to system requirements.

Figure 4A:
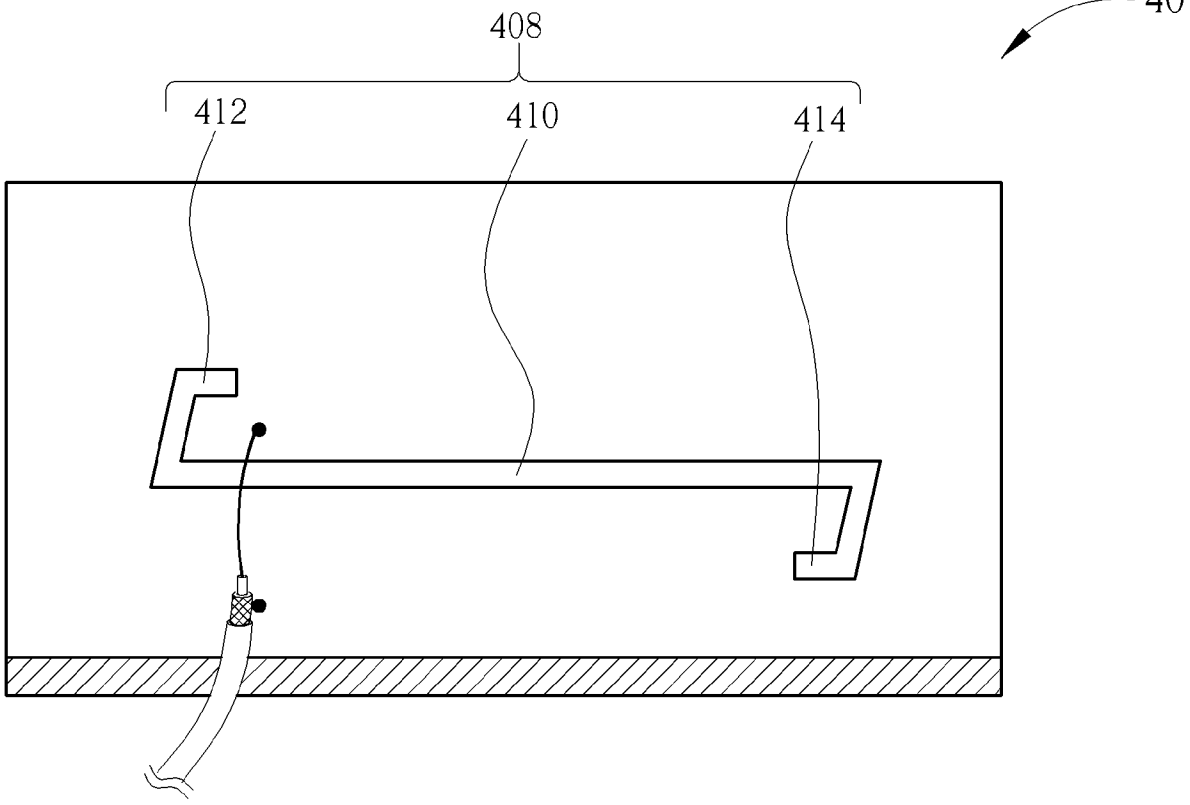
FIG. 4A is a schematic diagram of a dual-band antenna according to an embodiment of present invention.
Figure 4B:
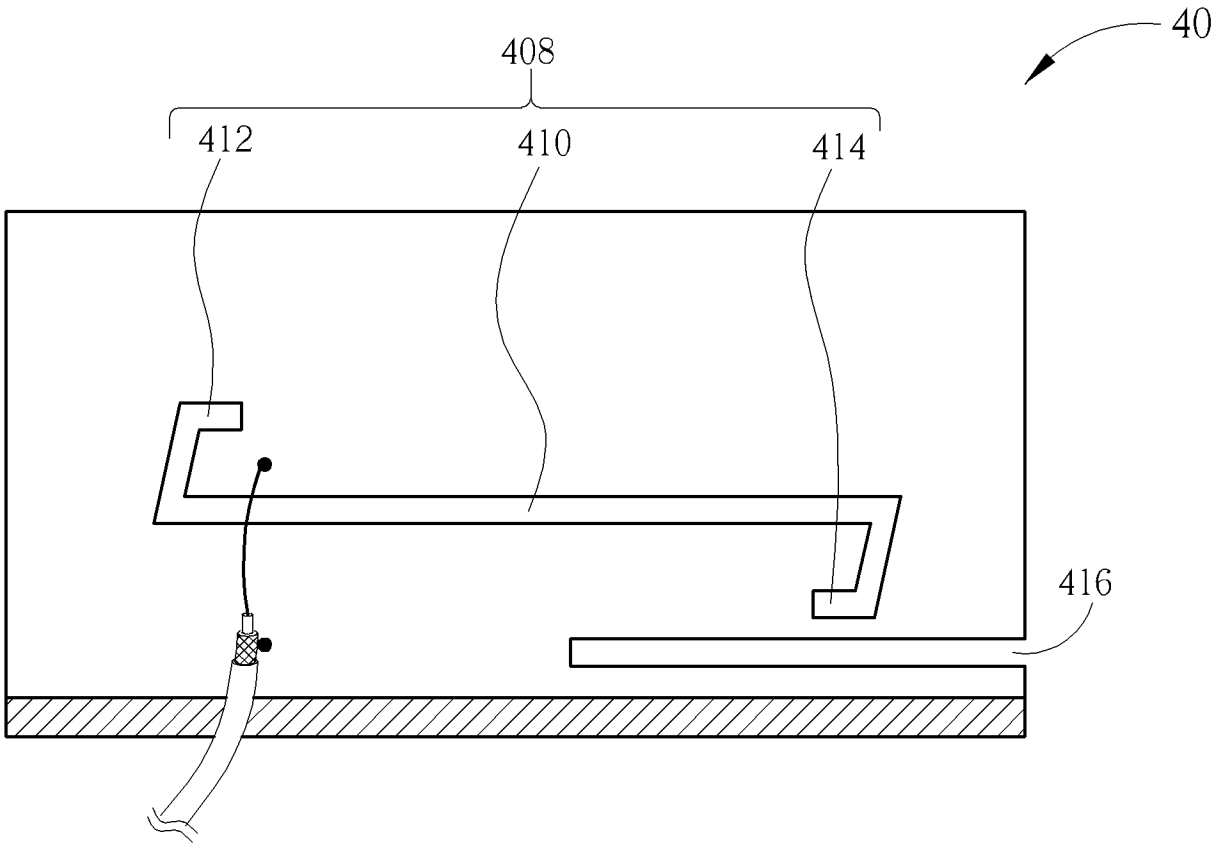
FIGS. 4B and 4C are schematic diagrams of adding a second rectangular slot and an extending slot respectively to the dual-band antenna in FIG. 4A.
Figure 4C:
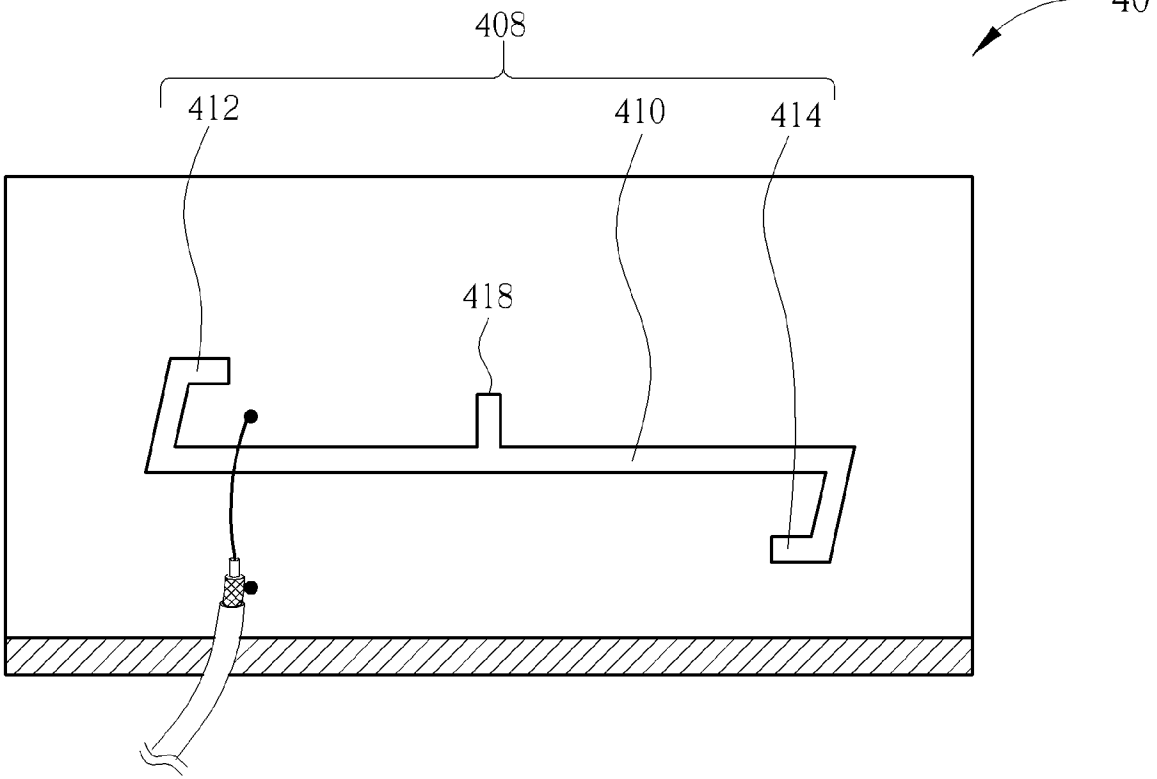

On the other hand, in FIG. 1, the first L-shape slot 112 and the second L-shape slot 114 are in a symmetrical form but are not limited thereto. For Example, FIG. 4A is a schematic diagram of a dual-band antenna 40. The structure of the dual-band antenna 40 is substantially the same as that of the dual-band antenna 10. Therefore, most of symbols are omitted and only a slot structure 408 comprising a first rectangular slot 410, a first L-shape slot 412 and a second L-shape slot 414 is marked. The rest parts can be referred to FIG. 1. Comparing with FIG. 1 and FIG. 4A, it can be seen that the difference between the dual-band antenna 40 and the dual-band antenna 10 is the first L-shaped slot 412 and the second L-shaped slot 414 of the dual-band antenna 40 are not symmetrical but upside down. The dual-band antenna 40 achieves the same objective of dual-band operation and area reduction as the dual-band antenna 10 does. Furthermore, by imitating FIGS. 3A and 3B, the dual-band antenna 40 may be added a second rectangular slot 416 and an extending slot 418, as shown in FIGS. 4B and 4C.

Except to the slot structure of ox horn, the present invention further provides a slot structure without perpendicular segments. Please refer to FIG. 5, which is a schematic diagram of a dual-band antenna 50 according to an embodiment of the present invention. The dual-band antenna 50 is a slot antenna in a wireless communication device such as a notebook computer system. For example, the dual-band antenna 50 may be formed on a barrel area or near a monitor of the notebook computer system, for receiving and transmitting wireless signals of two different frequency bands, such as 2.4 GHz and 5 GHz. The dual-band antenna 50 comprises a rectangular metal plane 500, a feeding terminal 502 and a ground element 504. A slot structure 508 is formed on the rectangular metal plane 500 by means of etching and punching. As can be seen from FIG. 5, the slot structure 508 substantially extends from a first side L1 to a second side L2 of the rectangular metal plane 500. The grounding element 104 is disposed on a third side L3 of the rectangular metal plane 500 for electrically connecting the rectangular metal plane 500 and a system ground of the wireless communication device. Accordingly, a low-frequency characteristic can be enhanced and a dimension of rectangular 500 can be reduced. In addition, the dual-band antenna 50 transmits signals through a signal transmission line 506 composed of a metal wire, an isolation layer, a metal weave and a protection layer from inside to outside. The metal wire electrically connects to the feeding terminal 502 by means of welding for transmitting signals. The isolation layer covers the metal wire. The metal weave covers the isolation layer and electrically connects to a welding point 503 of the rectangular metal plane 500 by the means of welding for connecting the signal ground. And, the protection layer covers the metal weave.

In the dual-band antenna 50, the slot structure 508 is a main portion constructing the slot antenna, and comprises a first slot 510 and a second slot 512. The first slot 510 and the second slot 512 are substantially parallel and extend from the first side L1 to the second side L2 of the rectangular metal plane 500. A length of the first slot 510 is less than a length of the second slot 512. As can be seen from FIG. 5, the slot structure 508 does not include perpendicular segments. The length of the second slot 512 is corresponding to a half of a wavelength of a signal corresponding to the lower frequency band of the two operation frequency bands (such as 2.4 GHz in 2.4 GHz and 5 GHz) and can receive and transmit signals of the higher frequency band by frequency multiplication. The first slot 510 is used to control the radiation status of the higher frequency band (5 GHz).

Figure 5:
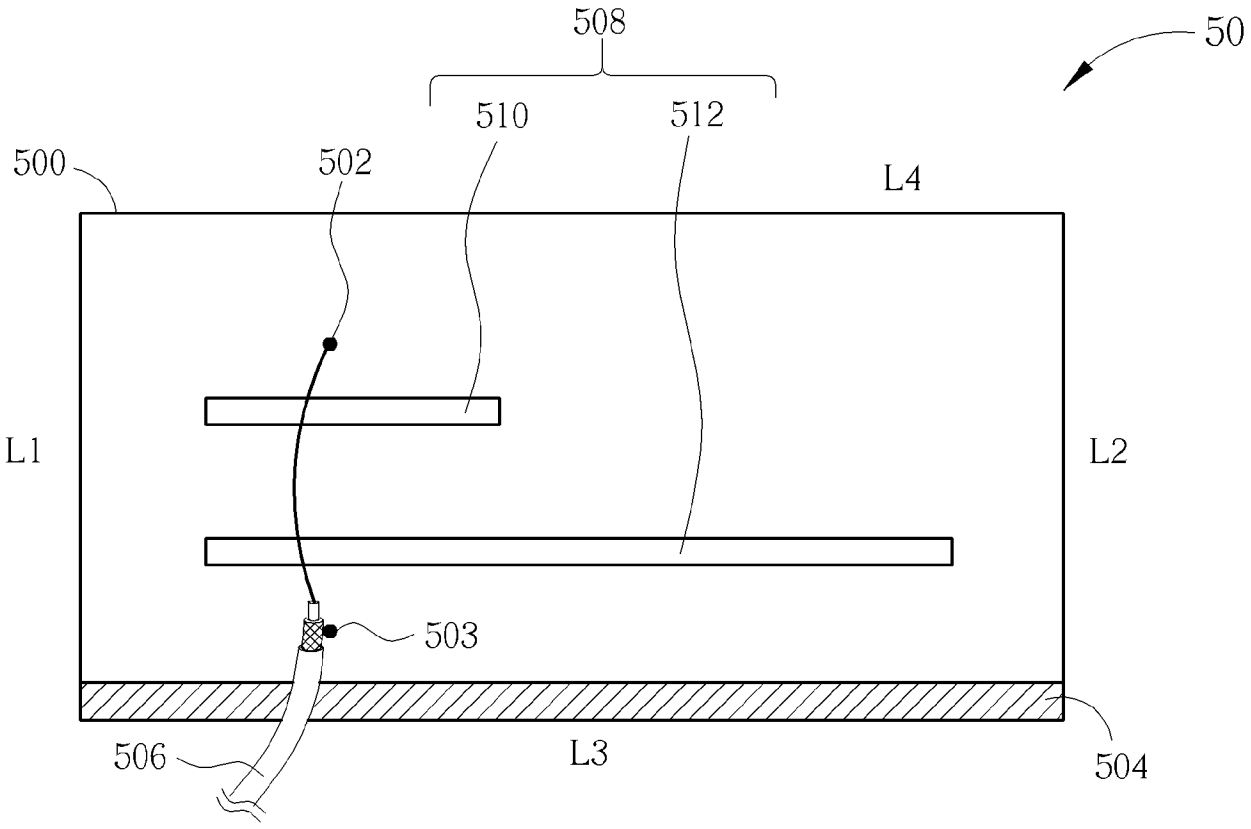
FIG. 5 to FIG. 10 are schematic diagrams of dual-band antennas according to embodiments of present invention.

Please note that the dual-band antenna 50 in FIG. 5 is an embodiment of the present invention, and those skilled in the art can make modification and alterations accordingly. For example, the feeding terminal 502 is not limited to be disposed on the first slot 510 (i.e., the feeding terminal 502 is disposed on between the first slot 510 and the fourth side L4 of the rectangular metal plane 500). Please refer to FIG. 6, which is a schematic diagram of a dual-band antenna 60 according to an embodiment of the present invention. The structures and compositions of the dual-band antenna 60 and the dual-band antenna 50 are similar. Thus, the same elements are presented by the same symbols for simplicity. As can be seen from FIG. 5 and FIG. 6, a difference between the dual-band antenna 60 and the dual-band antenna 50 is that a feeding terminal 602 of the dual-band antenna 60 is disposed between the first slot 510 and the second slot 512. The dual-band antenna 60 can achieve the objective of dual-band operation and area reduction as well. On the other hand, please refer to FIG. 7, which is a schematic diagram of a dual-band antenna 70 according to an embodiment of the present invention. The structures and compositions of the dual-band antenna 70 and the dual-band antenna 50 are similar. Thus, the same elements are presented by the same symbols for simplicity. As can be seen from FIG. 5 and FIG. 7, a difference between the dual-band antenna 70 and the dual-band antenna 50 is that a feeding terminal 702 of the dual-band antenna 70 is disposed under the second slot 512 (i.e., between the second slot 512 and the third side L3 of the rectangular metal plane 500) and a welding point 703 of the rectangular metal plane 500 are formed on the first slot 510 (i.e., between the first slot 510 and the fourth side L4 of the rectangular metal plane 500). The dual-band antenna 70 can achieve the objective of dual-band operation and area reduction as well. As can be seen, for the slot structure 508 with parallel and dual slots, the feeding terminal can be formed on any sides of the first slot 510 or the second slot 512.

Figure 8:
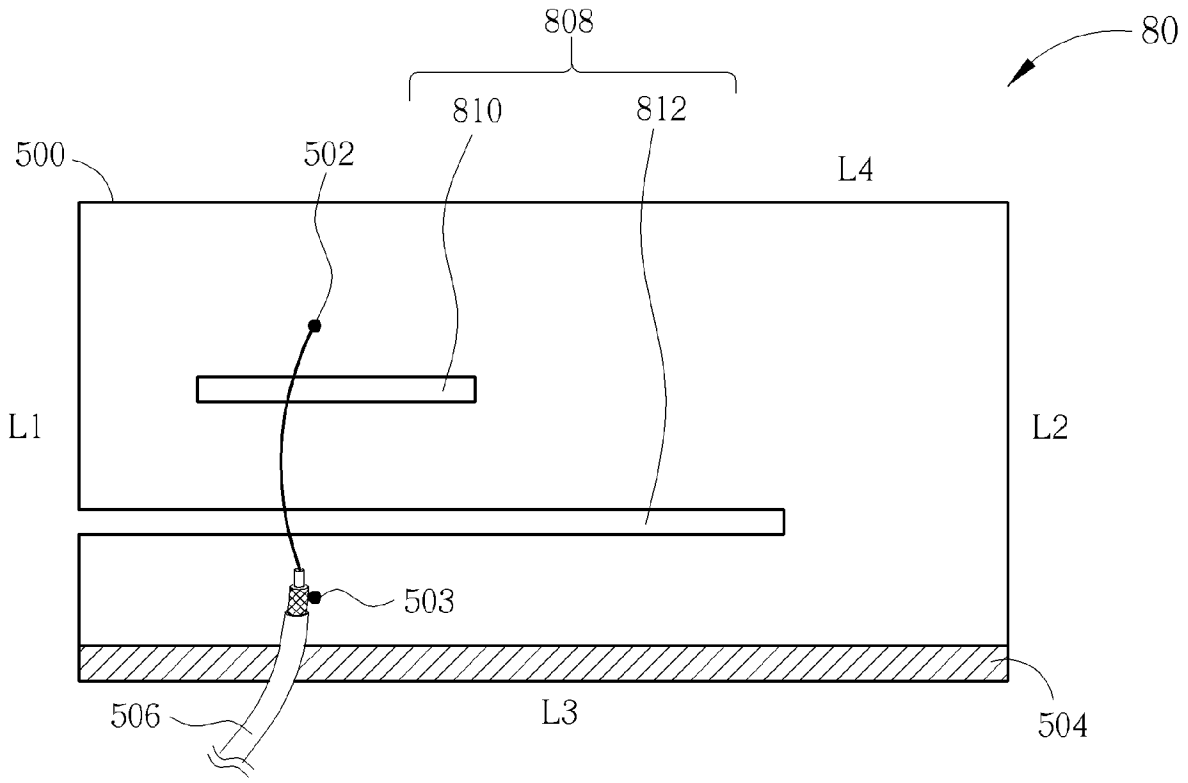
Figure 9:
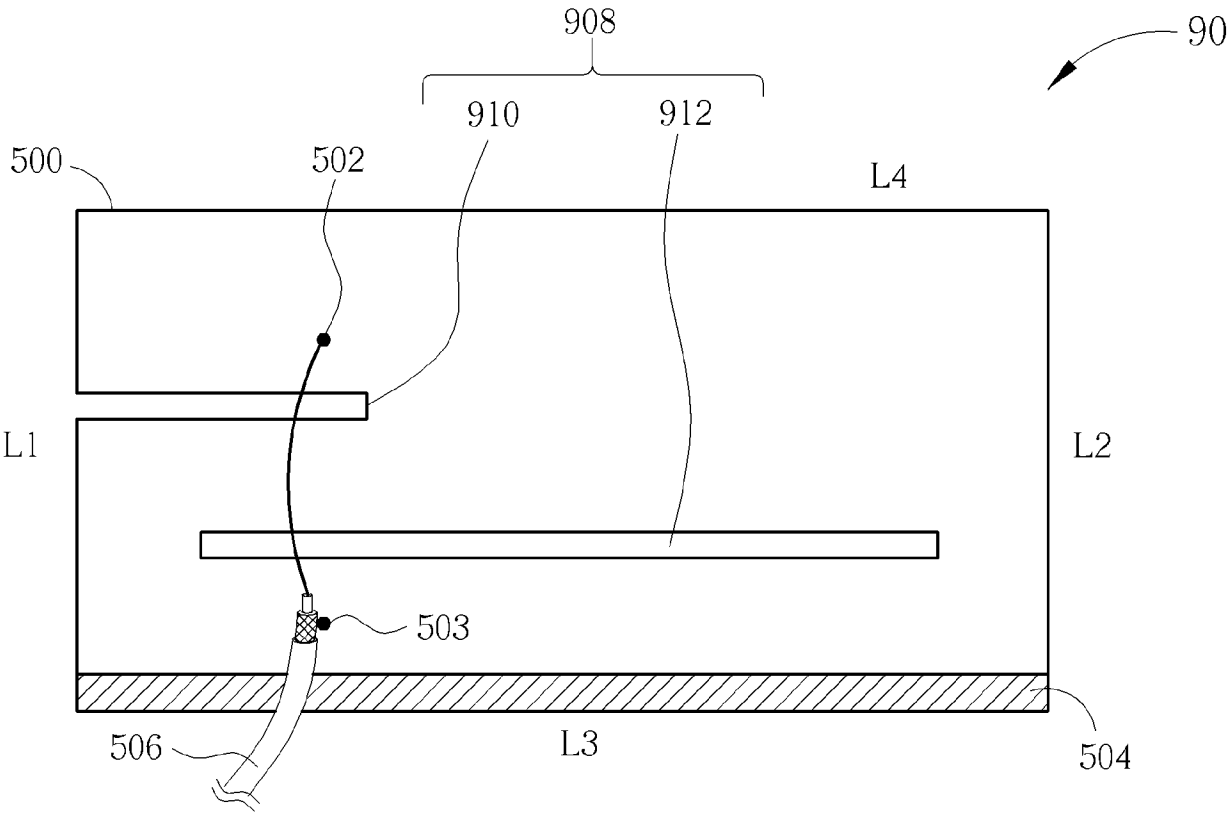
Figure 10:
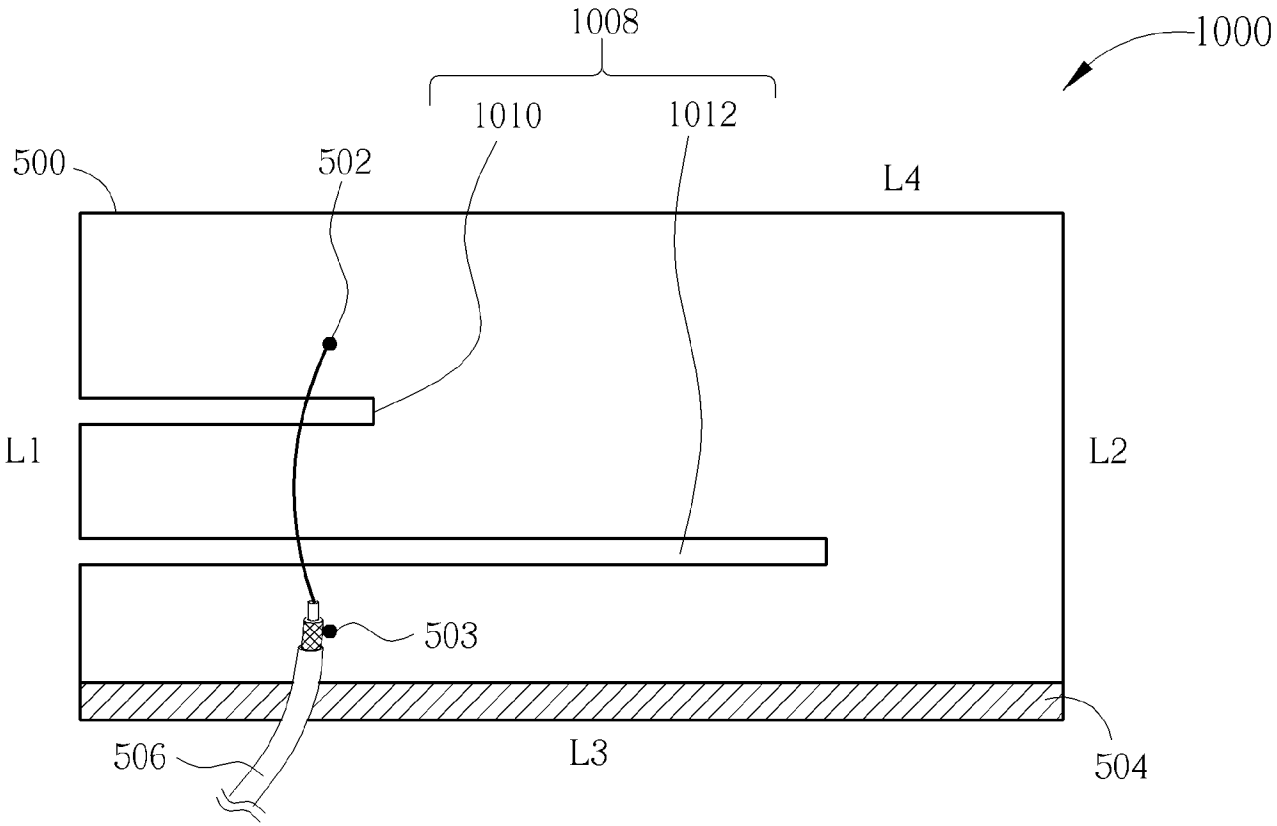

On the other hand, in FIG. 5, the first slot 510 and second slot 512 system are closed slots, but are not limited thereto. For example, FIG. 8 is a schematic diagram of a dual-band antenna 80. The structure of the dual-band antenna 80 is substantially the same as that of the dual-band antenna 50. Therefore, most of symbols are omitted and only a slot structure 808 comprising a first slot 810 and a second slot 812 is marked. The rest parts can be referred to FIG. 5. As can be seen from FIG. 5 and FIG. 8, a difference between the dual-band antenna 80 and the dual-band antenna 50 is that the second slot 812 of the dual-band antenna 80 is an open slot, e.g. an opening formed on the edge. The dual-band antenna 80 can achieve the same objective of dual-band operation and area reduction in dual-band antenna 50 as well. In addition, FIG. 9 is a schematic diagram of a dual-band antenna 90. The structure of the dual-band antenna 90 is substantially the same as the dual-band antenna 50. Therefore, most of symbols are omitted and only marked a slot structure 908 comprising a first slot 910 and a second slot 912. The rest of part can be referred to FIG. 5. As can be seen from FIG. 5 and FIG. 9, a difference between the dual-band antenna 90 and the dual-band antenna 50 is that the first slot 910 of the dual-band antenna 90 is an open slot, i.e., an opening formed on the edge. The dual-band antenna 90 achieves the same objective of dual-band operation and area reduction as the dual-band antenna 50 does. Finally, FIG. 10 is a schematic diagram of a dual-band antenna 1000. The structure of the dual-band antenna 1000 is substantially the same as that of the dual-band antenna 50. Therefore, most of symbols are omitted and only a slot structure 1008 comprising a first slot 1010 and a second slot 1012 is marked. The rest parts can be referred to FIG. 5. As can be seen from FIG. 5 and FIG. 10, a difference between the dual-band antenna 1000 and the dual-band antenna 50 is the first slot 1010 and the second slot 1012 of the dual-band antenna 1000 are both open slots, i.e., an opening formed on the both edges. The dual-band antenna 1000 achieves the same objective of dual-band operation and area reduction as the dual-band antenna 50 does.

Figure 6:
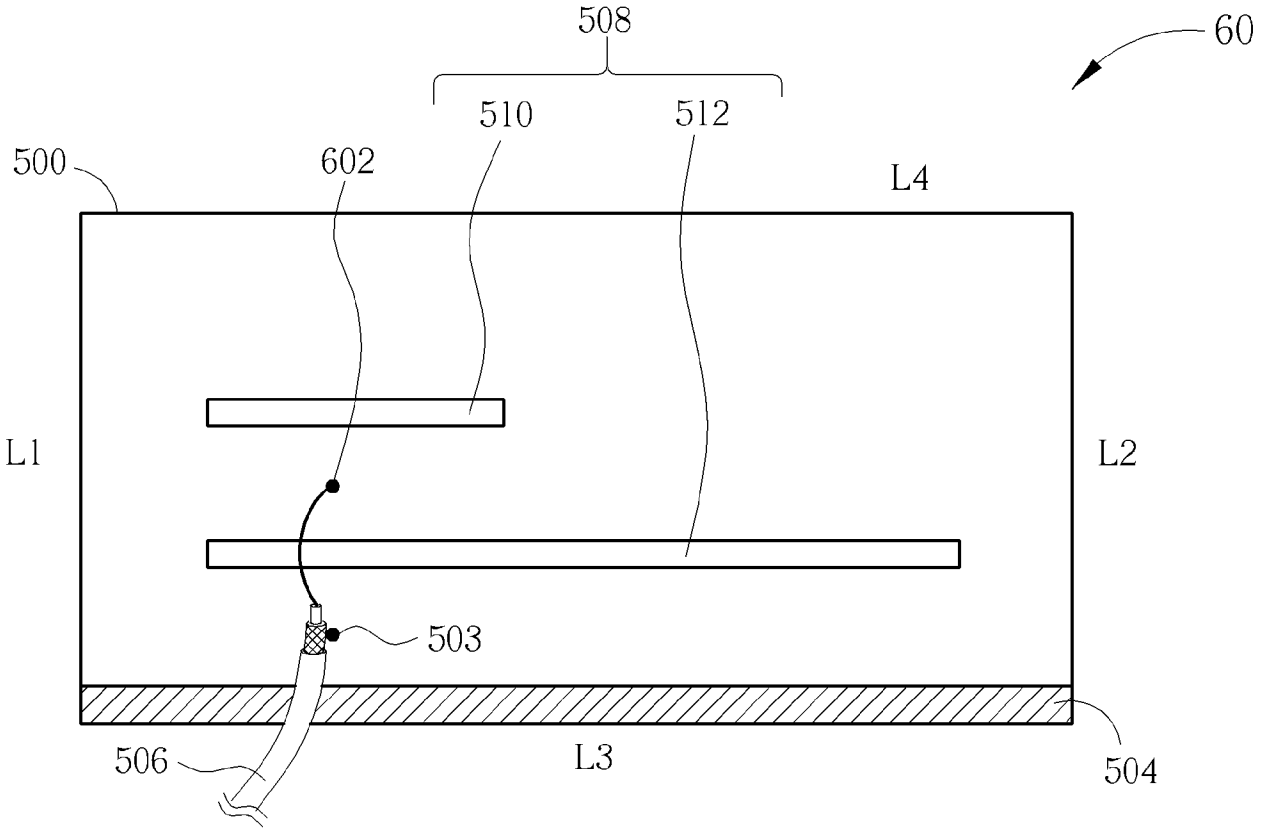
Figure 7:
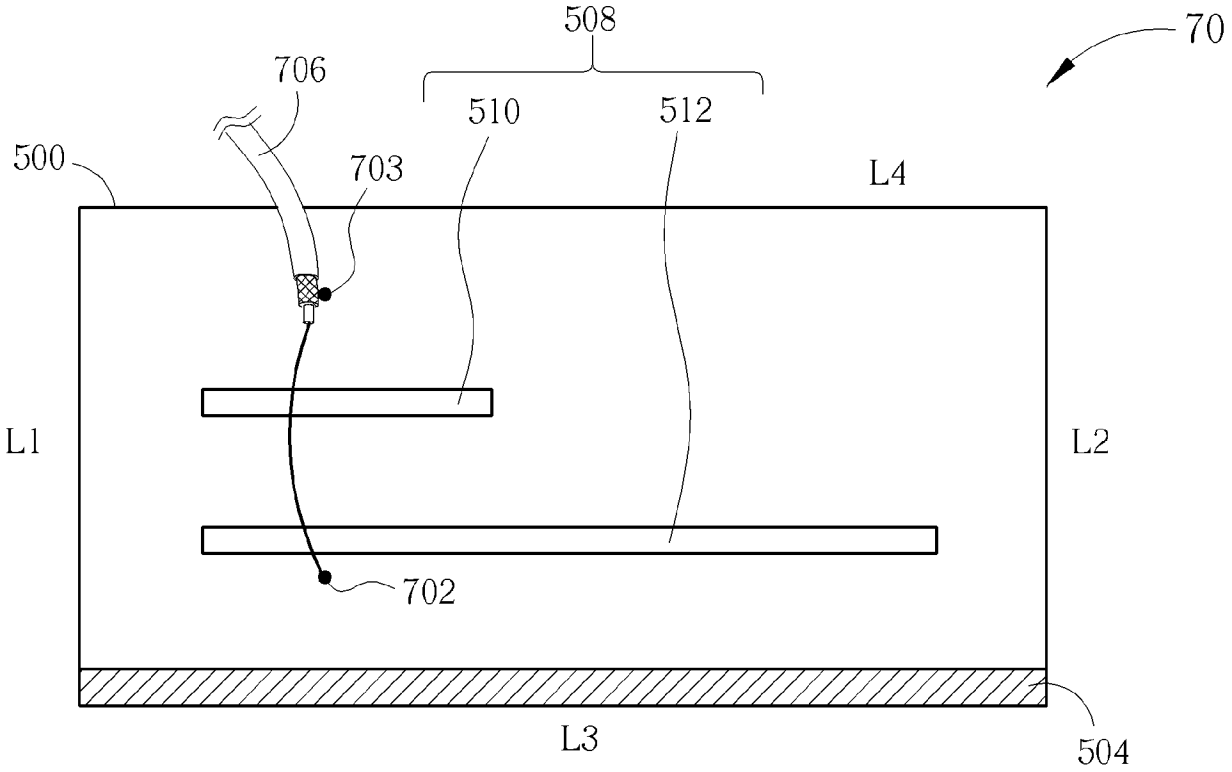

Certainly, position of feeding terminals or welding points in examples of FIG. 8 to FIG. 10 may also be modified according to the alterations shown in FIG. 6 and FIG. 7, and such alterations are still within the scope of the present invention.

Figure 11:
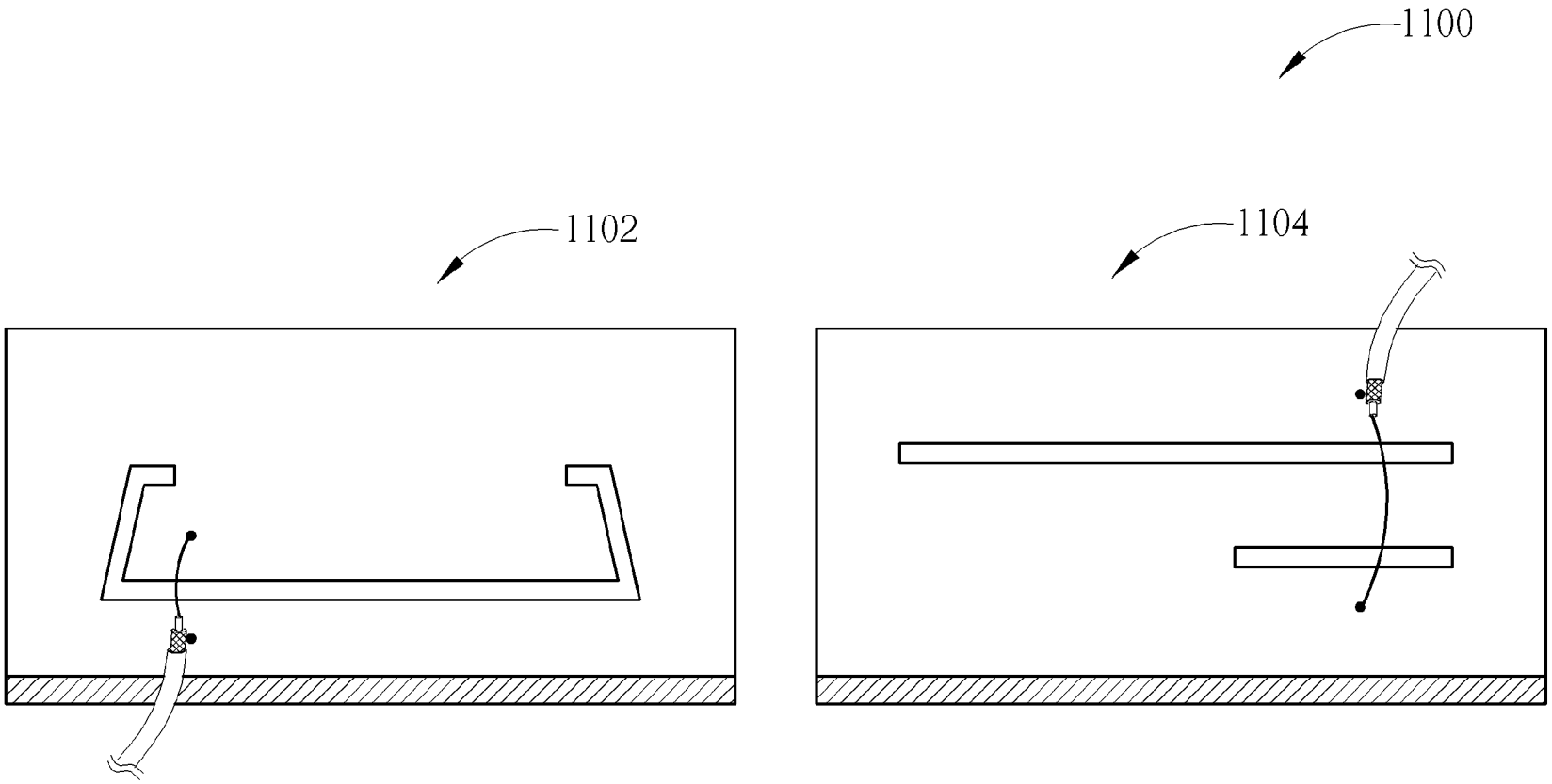
FIG. 11 is a schematic diagram of an antenna system according to an embodiment of present invention.
Figure 12:
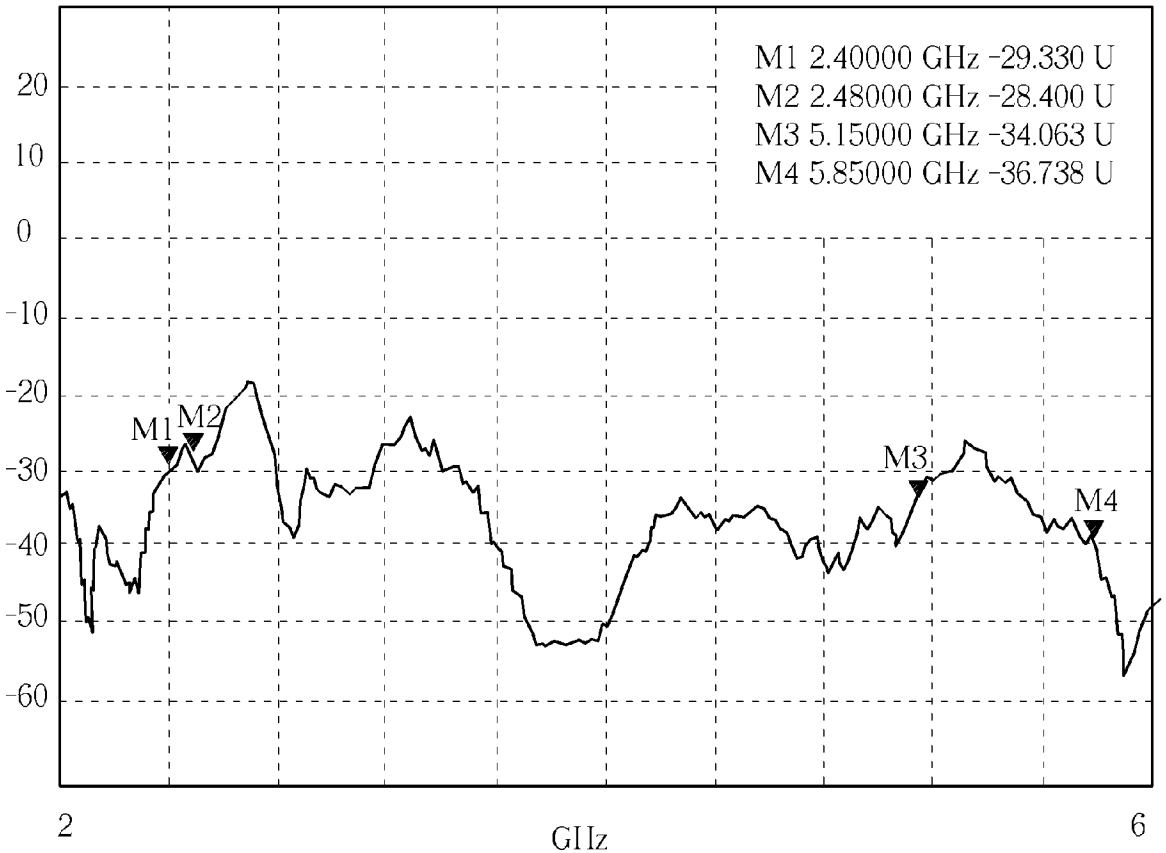
FIG. 12 is a schematic diagram of a voltage to standing wave ratio of the antenna system in FIG. 11.

Note that, the dual-band antenna 10 shown in FIG. 1, the dual-band antenna 50 shown in FIG. 5 or any derivative alterations all include a grounding element for electrically connecting the rectangular metal plane to the system ground to improve the low-frequency characteristic and reduce the dimension. In addition, those skilled in the art can make modifications such as the position of the grounding element, the lengths or widths of the slots, the gap between the slots, the angle of the L-shape slot, and the material, area and shape of the rectangular metal plane according to system requirements. Furthermore, the embodiments or the derivative alterations mentioned above are not independent to each other, and those skilled in the art can combine different embodiments according to system requirements. For example, please refer to FIG. 11, which is a schematic diagram of an antenna system 1100 according to an embodiment of the present invention. The antenna system 1100 is utilized in a wireless communication device such as a notebook computer system, and comprises a first antenna 1102 and a second antenna 1104. The antenna system 1100 may be formed on a barrel area or near a monitor of the notebook computer system for receiving and transmitting wireless signals of multiple frequency bands. It can be seen that the first antenna 1102 is the dual-band antenna 10 shown in FIG. 1 and the second antenna 1104 is the dual-band antenna 50 shown in FIG. 5 placed upside down. Isolation between the first antenna 1102 and the second antenna 1104 can be effectively enhanced through the upside down arrangement of the dual-band antennas 10 and 50, so as to enhance antenna efficiency. Please refer to FIG. 12, which is a schematic diagram of isolation of the first antenna 1102 and the second antenna 1104. It can be seen that the first antenna 1102 and second antenna 1104 maintain high isolation and avoid signal interfere, to maintain the normal operation in wireless communication.

Conventionally, it is difficult for a slot antenna to achieve dual-band operation in a restricted environment. In addition, larger space is needed to achieve dual-band operation, so the conventional slot antenna is designed for a single-band operation. In contrast, the present invention achieves area reduction by connecting a grounding element to the ground, and prolongs a path of surface current by the hooked slot or dual slots, to adjust the position of antenna pattern and the matching degree, etc. Accordingly, the present invention can be applied to a limited space and all-metal environment and can also maintain the efficiency of the antenna to ensure normal operation in wireless communication function.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dual-band antenna, for receiving or transmitting wireless signals of a first frequency band and a second frequency band in a wireless communication device, the dual-band antenna comprising:

a rectangular metal plane, formed with a slot structure substantially extending from a first side to a second side of the rectangular metal plane;

a feeding terminal, formed on the rectangular metal plane; and a grounding element, disposed on a third side or a fourth side of the rectangular metal plane, for electrically connecting the rectangular metal plane and a system ground of the wireless communication device;

wherein the first side is substantially parallel to the second side, the third side is substantially parallel to the fourth side, and the first side is substantially perpendicular to the third side or the fourth side;

the slot structure comprises:

a first rectangular slot, substantially extending from the first side to the second side of the rectangular metal plane;

a first L-shape slot, comprising a first segment, substantially extending from the third side to the fourth side of the rectangular metal plane, and a second segment, substantially extending from the first side to the second side of the rectangular metal plane and connecting to the first segment; and a second L-shape slot, comprising a first segment, substantially extending from the third side to the fourth side of the rectangular metal plane, and a second segment, substantially extending from the first side to the second side of the rectangular metal plane and connecting to the first segment.

2. The dual-band antenna of claim 1, wherein the first band is lower than the second band and a length of the first rectangular slot is substantially equal to a half of a wavelength of a signal corresponding to the first band.

3. The dual-band antenna of claim 1, wherein the feeding terminal is formed between the first rectangular slot and the first L-shape slot on the rectangular metal plane.

4. The dual-band antenna of claim 1, wherein a distance between the first segment of the first L-shape slot and the first side or the second side of the rectangular metal plane is substantially equal to 2 millimeters to 3 millimeters.

5. The dual-band antenna of claim 1, wherein a distance between the first segment of the second L-shape slot and the first side or the second side of the rectangular metal plane is substantially equal to 2 millimeters to 3 millimeters.

6. The dual-band antenna of claim 1, wherein the first L-shape slot and the second L-shape slot are disposed on a same side of the first rectangular slot.

7. The dual-band antenna of claim 1, wherein the first L-shape slot and the second L-shape slot are disposed on opposite sides of the first rectangular slot.

8. The dual-band antenna of claim 1, further comprising a second rectangular slot, parallel to the first rectangular slot, extending from the first side to the second side of the rectangular metal plane, and having an opening formed on the second side of the rectangular metal plane.

9. The dual-band antenna of claim 1, further comprising an extending slot, extending from the first rectangular slot to the fourth side of the rectangular metal plane.

10. The dual-band antenna of claim 1, further comprising a signal transmission line, which comprises:

a metal wire, electrically connecting to the feeding terminal by means of welding, for transmitting signals;

an isolation layer, covering the metal wire;

a metal weave, covering the isolation layer and electrically connecting to the rectangular metal plane by the means of welding, for connecting a signal ground; and a protection layer, covering the metal weave.

11. The dual-band antenna of claim 1, wherein the wireless communication device is a notebook computer system and the dual-band antenna is formed on a barrel area or near a monitor of the notebook computer system.

* * * * *